US005734306A

United States Patent [19]

Jantunen et al.

[11] Patent Number: 5,734,306

[45] Date of Patent: Mar. 31, 1998

[54] COAXIAL RESONATOR AND FILTER HAVING A MODULE BLOCK CONSTRUCTION

[75] Inventors: Heli Jantunen; Aimo Turunen, both of Oulu, Finland

[73] Assignee: ADC Solitra Oy, Kempele, Finland

[21] Appl. No.: 619,540

[22] PCT Filed: Sep. 12, 1994

[86] PCT No.: PCT/FI94/00398

§ 371 Date: Mar. 25, 1996

§ 102(e) Date: Mar. 25, 1996

[87] PCT Pub. No.: WO95/09453

PCT Pub. Date: Apr. 6, 1995

[30] Foreign Application Priority Data

Sep. 28, 1993 [FI] Finland ..... 934246

[51] Int. Cl.[6] ..... H01P 1/202; H01P 7/04

[52] U.S. Cl. ..... 333/206; 333/222; 333/203

[58] Field of Search ..... 333/202, 202 DB, 333/203, 206, 219, 222

[56] References Cited

U.S. PATENT DOCUMENTS

Re. 34,898 4/1995 Turunen et al. ..... 333/206

5,160,905 11/1992 Hoang ..... 333/203 X 5,331,300 7/1994 Shimizu et al. ..... 333/206 X

FOREIGN PATENT DOCUMENTS

566743 A1 10/1993 European Pat. Off. .

2675638 10/1992 France ..... 333/202 DB 0187501 8/1991 Japan ..... 333/203

5343905 12/1993 Japan ..... 333/202 DB 6204721 7/1994 Japan ..... 333/202

*Primary Examiner*—Robert Pascal

*Assistant Examiner*—Barbara Summons

*Attorney, Agent, or Firm*—Klauber & Jackson

[57] ABSTRACT

A coaxial resonator of modular construction, wherein the resonator is formed from two or more blocks, or modules, that are fastened to each other. Conductively plated surfaces of the modules may form the center conductor and at least part of the shield of the resonator. A dielectric layer is formed at least partially from the module material, typically ceramic. The module blocks are advantageously made by being cut from ceramic substrate. A resonator, or filter including at least one resonator, can be manufactured without special tools, and may be fabricated by manually assembling modules or by using automatic assembly methods, such as by known printed circuit board assembly techniques.

18 Claims, 3 Drawing Sheets

COAXIAL RESONATOR AND FILTER HAVING A MODULE BLOCK CONSTRUCTION

This application claims benefit of international application PCT/FI94/00398 filed Sep. 12, 1994.

BACKGROUND OF THE INVENTION

1. Field of the Invention

The object of the present invention is a coaxial resonator construction in which a center conductor is coaxially surrounded by a conductive shield. An insulating layer is situated between the center conductor and the shield. The insulating layer may be ceramic or air, for example.

2. Description of the Prior Art

It is known that a coaxial resonator can be manufactured from a ceramic block that has a bottom surface, a top surface and side surfaces. A hole that is plated with a conductive material passes through the ceramic block from the top surface to the bottom surface. This hole forms the center conductor of the resonator. The shield is formed by a plating of conductive material on the outer surfaces of the ceramic block. The plating on the outer surface covers the side surfaces and most of the bottom surface. There is no plating on the top surface of the ceramic block at least near the hole that forms the center conductor. The plating of the center conductor is connected to the plating of the shield at the bottom surface of the block. A coaxial resonator that is created from a ceramic block is also called a ceramic resonator.

Ceramic resonators are especially useful in radio frequency devices with a frequency range that extends beyond 1000 MHz. At very high frequencies, the length of the center conductor of a resonator may be only a few millimeters, which is approximately equal to one quarter of the wavelength.

The manufacturing process of ceramic resonators is problematic. It is difficult to machine a ceramic block because ceramic is a very hard material. A different special tool that presses the resonator into its final shape and makes the hole into the ceramic block must be manufactured for producing each different size of ceramic resonator. After the ceramic mixture has been formed, the excess components of the mixture are burned off and finally the ceramic block is sintered at approximately 1200° C. The special tools used in the manufacturing process are expensive and machining the ceramic material wears the tools quickly. Because of tool wear, the dimensions of the ceramic blocks change, whereupon, for example, an optimal ratio between the diameter of the shield and the diameter of the center conductor formed by the conductive material-plated hole in the ceramic block is no longer achieved. This causes changes in the electrical characteristics of the resonator. The punches that are used to make the holes in very small resonators are so thin that they cannot withstand the pressure that is used in the manufacturing process and consequentially break easily.

It is also difficult to manufacture a filter. In the manufacturing process of a filter, several holes that function as resonators are made in each ceramic block. The degree of inductive and capacitive coupling between the holes is controlled by placing the holes at suitable distances from each other. The degree of coupling between the resonators of the filter does not always meet specifications due to the manufacturing process and the tools used. Prior art offers several methods and constructions for controlling the degree of coupling between the resonators. The degree of coupling can be controlled with the pattern of the conductor on the surface of the ceramic block, as described in Finnish patent specification 87407. None of the known methods can remove the problem, i.e., can "move a hole from one place to another." A faulty component must often be rejected, resulting in lower production line output.

Another manufacturing problem is related to the manufacture of the tool itself. The first version of the tool usually does not meet the specifications compiled for it, and therefore the dimensions of a resonator that is made with the tool may not meet the specifications set for it. The sintering process in particular may cause shrinkage that is difficult to estimate beforehand. If the tool is incorrectly constructed, the resonator that is created under pressure may crumble due to internal stress. Because of the reasons outlined above, several improved versions of the tool may have to be made before specifications are met. It is time-consuming to produce and test several versions of a tool, creating extra expenses that affect the price of the end product.

The present invention describes a coaxial resonator construction that is free of the manufacturing problems outlined above.

SUMMARY OF THE INVENTION

The construction in the present invention is modular. The construction is made up of separate blocks or modules that are made from dielectric material. The modules are connected to achieve a desired construction that results in an easily adjustable coaxial resonator construction without having to use presently known tools.

The present invention is described in detail below, with references to the enclosed drawings.

DESCRIPTION OF THE PREFERRED EMBODIMENTS

The resonator described in the present invention is built from two or more blocks, or modules. The cross-section of the blocks is typically rectangular or square. Suitable blocks are advantageously made by cutting them from a ceramic substrate, for example. The blocks are connected to each other to form a resonator like the one shown in FIG. 1, for example, which represents the simplest mode of the resonator construction that is the object of the present invention.

Figure 1:
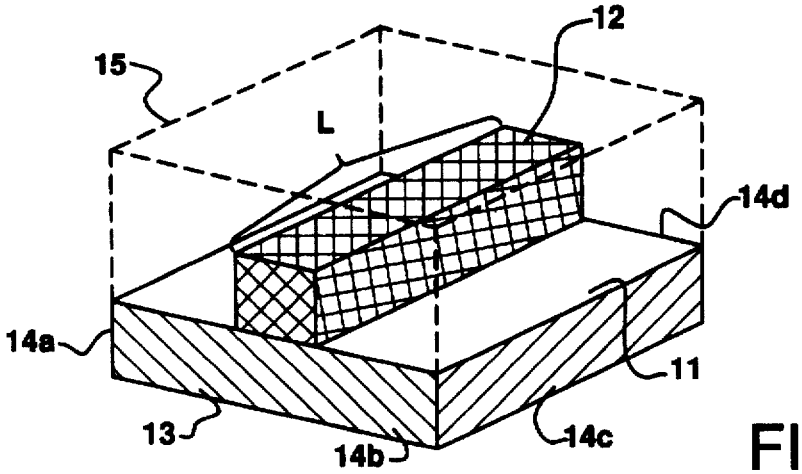
FIG. 1 shows the first embodiment of the resonator construction described in the present invention.

The resonator in FIG. 1 is made up of a body block 11 and a center conductor block 12. The body block 11 is made from dielectric material such as ceramic. The center conductor block 12, whose center conductor is formed by conductive plating such as silver paste, is fastened onto the body block 11. The center conductor block corresponds to the center conductor or plated hole of a coaxial resonator of prior art. The center conductor block 12 can be made from ceramic or any other material that is platable with a conductive material. The center conductor block material may also be conductive, in which case conductive plating is unnecessary. The center conductor block 12 is fastened to the body block 11 with silver paste such as that which is used to plate the center conductor block, for example. The bottom surface 13 and the side surfaces 14*a*, 14*b*, 14*c* and 14*d* of the body block 11 are plated with a conductive plating that forms part of the conductive shield of the resonator. In the resonator shown in FIG. 1, the remainder of the shield is formed from a conductive cover plate 15 that is fitted over the assembly formed by the body block 11 and the center conductor block 12 at a suitable distance from the center conductor block. Cover plate 15 (depicted with a dotted line in the figure) is fastened to the side surfaces 14*a* and 14*c* with conductive plating material, for example. The dielectric layer between the shield and the center conductor of the resonator shown in FIG. 1 is mainly formed by the layer of air between the cover plate 15 and the center conductor block 12. The body block 11 makes up about one third of the dielectric layer. The length, L, of the center conductor block 12 corresponds to one fourth of the wavelength, as is characteristic of transmission line resonators.

Figure 2:
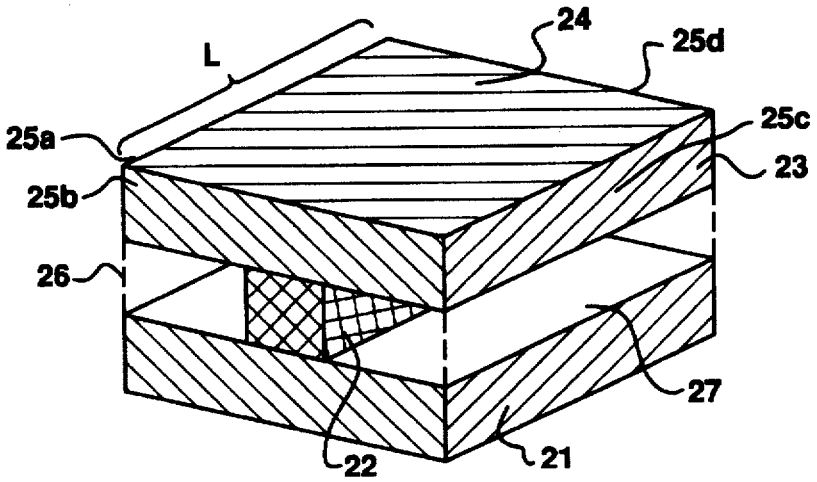
FIG. 2 shows the second embodiment of the resonator construction described in the present invention.

A smaller resonator can be made with the construction shown in FIG. 2. In this figure, the construction shown in FIG. 1 has been modified by adding a cover block 23 over the assembly formed by the body block 21 and the center conductor block 22. The cover block 23 is cut from a ceramic substrate in the same way as the body block and fastened to the center conductor block 22 with silver paste plating material, for example. The top surface 24 and the side surfaces 25*a*, 25*b*, 25*c* and 25*d* of the cover block are plated with a conductive plating material. The side plates of conductive material 26 and 27 that are depicted with dotted lines in FIG. 2 are optional as far as the functioning of the resonator is concerned, because a sufficient shield surface area is created by the conductively plated sides of the body block and the cover block. In this example, the ceramic body block and cover block make up more than two-thirds of the dielectric layer of the resonator. The remainder of the dielectric layer is formed by the layer of air between the center conductor block 22 and the optional side plates. The length, L, of the center conductor block 22 is less than in the example of FIG. 1 because the dielectric constant of the dielectric layer is larger than in FIG. 1.

Figure 3:
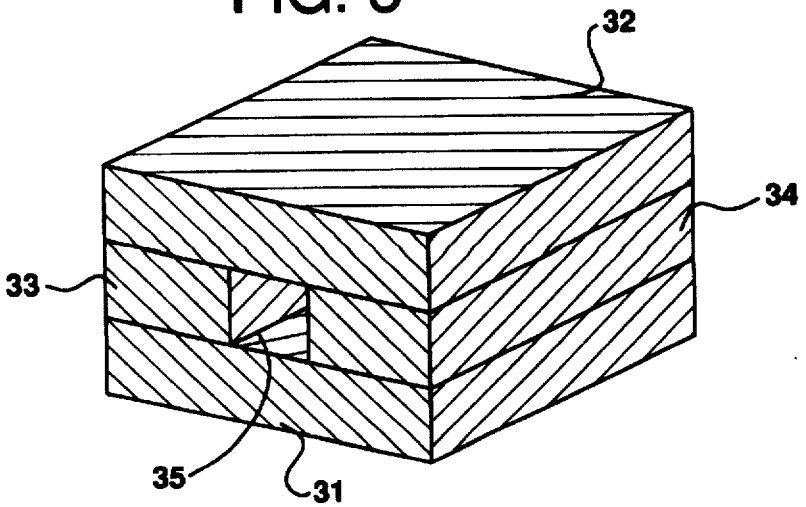
FIG. 3 shows the third embodiment of the resonator construction described in the present invention and FIG. 4 shows an example of a filter realized with the construction described in the present invention.

FIG. 3 shows another variation of the resonator construction described in the present invention. The resonator in FIG. 3 also has a body block 31 and a cover block 32, but instead of a center conductor block, the construction has side blocks 33 and 34, which are cut from a ceramic substrate of suitable thickness. As shown in FIG. 3, the body, cover and side blocks are fastened to each other with strips of silver paste, for example. The center conductor of the resonator is formed by the plated hole 35 that replaces the center conductor block that is used in the first two embodiments. The conductive plating of the center conductor is formed by one of the conductively plated sides of the body, cover and side blocks. The shield of the resonator is formed by the conductively plated outer surface of the assembly made up of the body, cover and side blocks. The construction of this embodiment is functionally identical with the "hole in a ceramic block" construction of the prior art.

Figure 4:
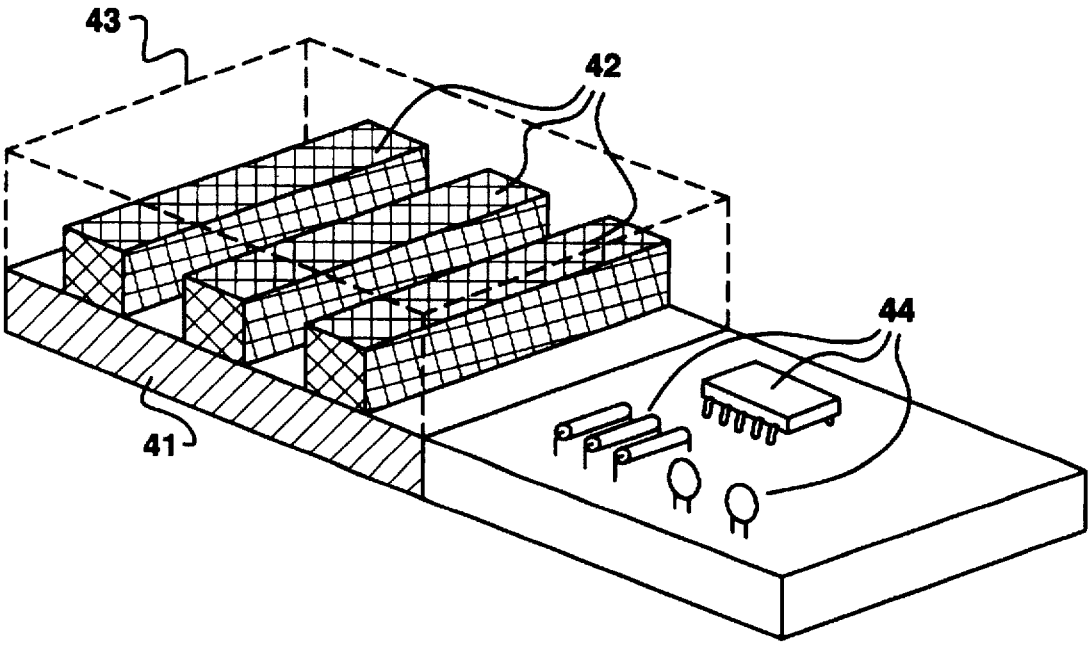

The example depicted in FIG. 4 shows how the construction described in the present invention is used to create a filter. The body block 41 functions as the base for several center conductor blocks 42. The filter shown in FIG. 4 is made up of three resonators. The center conductor blocks 42 form the center conductors of the resonators. The center conductor blocks 42 are covered with cover plate 43 as in the embodiment shown in FIG. 1. The cover plate is drawn with a dotted line in the figure.

Variations of the invention such as the ones shown in FIGS. 1, 2 and 3 can be applied to filter structures that are formed from several resonators. It is possible to place a ceramic cover block over the center conductor blocks 42 as shown in the embodiment of FIG. 2. The center conductors of parallel resonators can be formed by holes surrounded by body, cover and side blocks as shown in the embodiment of FIG. 3. Side blocks with suitable cross-sectional dimensions can also be placed between and on the sides of the center conductor blocks 42, where they will affect the degree of coupling between the resonators. The degree of coupling between the resonators is easy to adjust by changing their relative distances, i.e., by moving the center conductor blocks 42 in relation to each other. The degree of coupling can also be adjusted by printing conductive patterns on the surface of the ceramic block, as is known.

FIG. 4 illustrates a preferred embodiment of the invention, in which the body block 41 is used as a mounting base for discrete electronic components 44 in place of a printed circuit board to implement an amplifier, for example. Also, better-quality capacitances can be created with conductive patterns on the ceramic plate than can be created with conductive patterns on conventional printed circuit board material, due to the high dielectric constant of ceramic.

Figure 5:
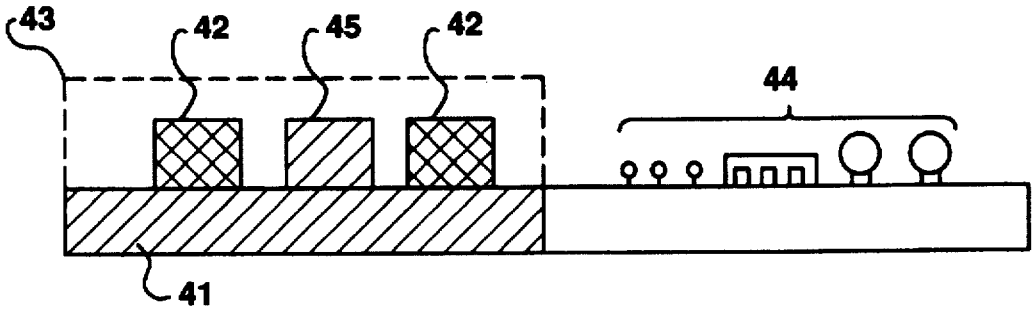
FIG. 5 shows another embodiment of a filter according to the present invention wherein a side block is placed between center conductor blocks.

FIG. 5 illustrates a filter constructed according to the present invention wherein a side block 45 is placed between center conductor blocks 42 in order to affect the degree of coupling therebetween.

The construction described in the present invention can be applied to assemble resonators with the same principle as in automatic circuit board assembly. An automatic assembly machine can handle the various parts of the resonators, or the body block, center conductor block, cover block and side blocks, in the same way as it handles discrete electronic components such as resistors or capacitors.

In one advantageous embodiment of the invention, basic resonator blocks and possibly other components are assembled on a blank ceramic substrate according to a specific layout plan and then the assembled blank is cut into parts that form different kinds of filters, for example. The blocks and any conductive patterns can be plated with conductive material before the blank is assembled. It is easier to add the conductive pattern to the even surface of the ceramic substrate than to add the pattern to the surfaces of small ceramic blocks as is done in the methods of prior art.

It is easy to adjust the parameters of a prototype of a new resonator model when it is constructed as described in the present invention. It is easy to move the center conductor block to the desired position. The dielectric layer between the center conductor and the shield can be enhanced with blocks as described in the present invention. The dielectric constant can be reduced by removing blocks from the resonator construction. When this type of experimentation with the prototype produces the desired results, the final position data can be entered into the memory of the automatic assembly machine, and an unlimited number of identical resonator constructions can be produced.

Manual production of resonators is also possible by using the same principle, but without the expensive tools needed in prior art.

The manufacturing procedure of the blocks described in the present invention is simple: a ceramic substrate is manufactured or ordered from a firm specialized in mass-production of ceramic substrates. Ceramic substrates with standard dimensions that are made from aluminum oxide, for example, are commercially available. The ceramic substrate can be cut into ceramic blocks of suitable size, from which the resonators are then assembled.

The length of the blocks may be different. For example, the center conductor block may be shorter than the body or cover blocks, in which case it will remain hidden inside the construction.

In one advantageous embodiment the center conductor block that forms the center conductor is hollow and open-ended, resulting in a more lightweight construction.

Figure 6:
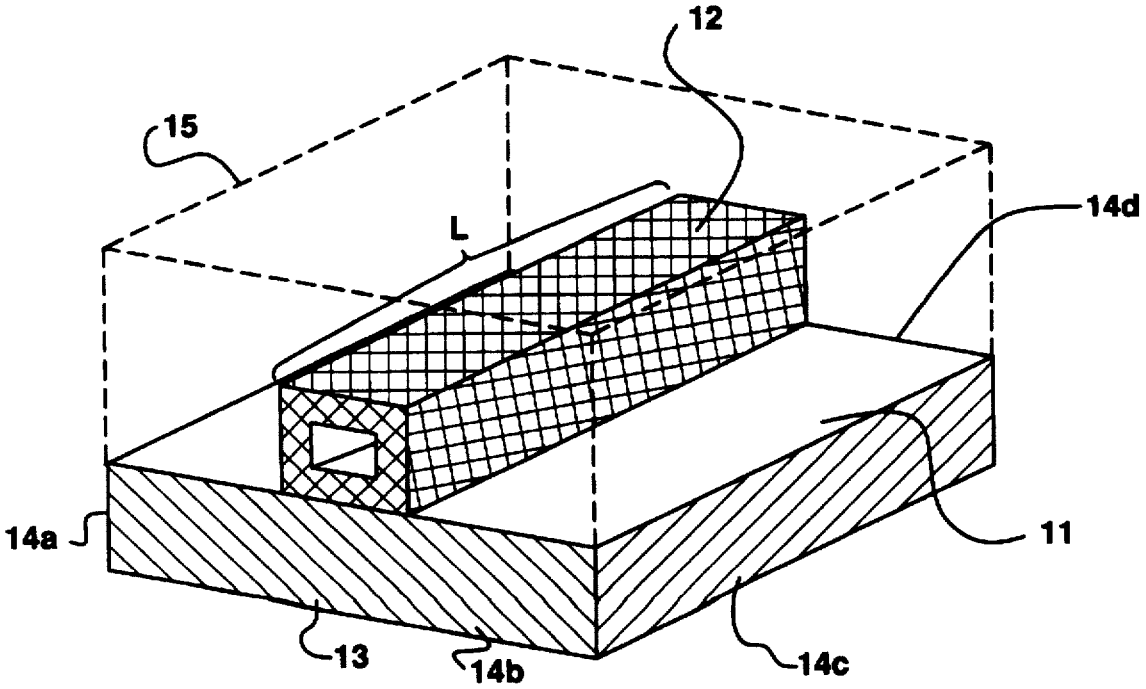
FIG. 6 shows another embodiment of a resonator according to the present invention wherein the center conductor block is hollow and open-ended.

FIG. 6 illustrates another embodiment of the resonator constructed according to the present invention wherein the center conductor block 12 is hollow and open-ended.

The center conductor block may be completely plated or only plated on one or more of its longitudinal surfaces with a conductive material. If necessary, the plating that makes up the center conductor can also be extended beyond the center conductor block, in practice, to the surface of the body or cover block that the center conductor block is fastened to.

The construction described in the present invention is meaningful in several ways. It brings a completely new dimension to resonator manufacturing technology. Actually, one can no longer speak of resonator manufacturing, which is often associated with material handling and special tools, but rather of resonator assembly from basic components, or the blocks described in the above examples. Assembly with blocks is an easily predictable process. The resulting resonators or filters are alike. It is also easy to adjust the electrical parameters of the construction, such as the resonant frequency, characteristic impedance, or in the case of several resonators, their degree of inductive or capacitive coupling, because the relative positions of all the blocks can be changed.

The problems that are associated with the manufacture of the center conductor of small resonators in particular are eliminated in two ways with the construction described in the present invention: by making a center conductor block with a small cross sectional area by cutting it from a ceramic substrate and plating it with a conductive material as described in the embodiments of FIG. 1 or 2, or by assembling the resonator from blocks that form a hole that is sufficiently small as described in the embodiment of FIG. 3. According to the third embodiment it is also easy to adjust the size of the hole.

The method shown in FIG. 4 is also suitable for manufacturing hybrid circuits. In a hybrid circuit application, discrete components are assembled on one end of the body block.

The size, number and position of the blocks that form the resonator are not limited to the above examples. The construction can be modified within the limits of the patent claims.

What is claimed is:

1. A coaxial resonator comprising:

a conductive shield;

a center conductor disposed longitudinally within said shield; and a dielectric layer disposed between said shield and said center conductor;

wherein said resonator is modularly formed from at least two module blocks, each block having a right-quadrilateral cross-section and a plurality of outer surfaces including substantially flat longitudinal sides;

wherein each said block is attached to at least one other said block;

wherein said center conductor further comprises conductive plating disposed on at least part of at least one of said longitudinal sides of at least one of said blocks;

wherein said shield further comprises conductive plating disposed on at least part of at least one of said outer surfaces of at least one of said blocks, other than one of said longitudinal sides forming said center conductor;

wherein said dielectric layer further comprises at least part of at least one of said blocks; and wherein at least one of said longitudinal sides of at least one of said blocks at least partially defines an inner cavity.

2. The resonator according to claim 1 wherein said dielectric layer further comprises said inner cavity.

3. The resonator according to claim 1 wherein at least one of said blocks is at least as long as said center conductor.

4. The resonator according to claim 1 wherein at least one of said blocks is longer than said center conductor.

5. The resonator according to claim 1 wherein at least one of said blocks has a rectangular cross-section.

6. The resonator according to claim 1 wherein at least one of said blocks has a square cross-section.

7. The resonator according to claim 1 wherein at least one of said blocks is comprised of ceramic.

8. The resonator according to claim 1 wherein said center conductor further comprises one module block wherein each said external surface of said block is conductive.

9. The resonator according to claim 1 wherein said center conductor further comprises one module block formed entirely from conductive material.

10. The resonator according to claim 8 or 9 wherein said one module block comprising said center conductor is substantially hollow and open-ended.

11. The resonator according to claim 1 wherein said center conductor is substantially straight.

12. A filter comprising at least one coaxial resonator, each said resonator comprising:

a conductive shield;

a center conductor disposed longitudinally within said shield; and a dielectric layer disposed between said shield and said center conductor;

wherein each said resonator is modularly formed from at least two module blocks, each block having a right-quadrilateral cross-section and a plurality of outer surfaces including substantially flat longitudinal sides;

wherein each said block is attached to at least one other said block;

wherein said center conductor further comprises conductive plating disposed on at least part of at least one of said longitudinal sides of at least one of said blocks;

wherein said shield further comprises conductive plating disposed on at least part of at least one of said outer surfaces of at least one of said blocks, other than one of said longitudinal sides forming said center conductor;

wherein said dielectric layer further comprises at least part of at least one of said blocks; and wherein at least one of said longitudinal sides of at least one of said blocks at least partially defines an inner cavity.

13. The filter according to claim 12 wherein said dielectric layer further comprises said inner cavity.

14. The filter according to claim 12 wherein at least one of said blocks is at least as long as said center conductor.

15. The filter according to claim 13 wherein at least one of said blocks is longer than said center conductor.

16. The filter according to claim 12 wherein at least one of said blocks further comprises a plane-like plate which is adapted to receive at least one circuit board component.

17. The filter according to claim 12 wherein at least one of said blocks further comprises a plane-like body to which said center conductor is attached.

18. The filter according to claim 12 further comprising a plurality of resonators, and wherein said module blocks further comprise at least one coupling block, wherein said coupling block is disposed between two adjacent resonators of said plurality of resonators in order to adjust the degree of inductive and capacitive coupling between said two adjacent resonators.

* * * * *